United States Patent [19]

Masuda et al.

[11] Patent Number: 4,651,684

[45] Date of Patent: Mar. 24, 1987

[54] VALVE TIMING CONTROL SYSTEM FOR INTERNAL COMBUSTION ENGINE

[75] Inventors: Shunji Masuda; Hiroyuki Oda; Yasuyuki Morita, all of Hiroshima, Japan

[73] Assignee: Mazda Motor Corporation, Hiroshima, Japan

[21] Appl. No.: 530,737

[22] Filed: Sep. 9, 1983

[30] Foreign Application Priority Data

Sep. 10, 1982 [JP] Japan ..... 57-158566

[51] Int. Cl.[4] ..... F01L 1/34

[52] U.S. Cl. ..... 123/90.16; 123/315; 123/348; 123/432

[58] Field of Search ..... 123/90.16, 348, 315, 123/432, 90.15, 315

[56] References Cited

U.S. PATENT DOCUMENTS 3,211,137 10/1965 Love ..... 123/432
3,403,663 10/1968 Wagner ..... 123/90.16
4,285,310 8/1981 Takizawa et al. ..... 123/90.16 X
4,300,504 11/1981 Tezuka ..... 123/432
4,446,825 5/1984 Geardini et al. ..... 123/90.15 X

FOREIGN PATENT DOCUMENTS 2901186 7/1980 Fed. Rep. of Germany ..... 123/432
955988 4/1964 United Kingdom ..... 123/90.16
2063362 6/1981 United Kingdom ..... 123/315

*Primary Examiner*—William R. Cline
*Assistant Examiner*—Peggy A. Neils
*Attorney, Agent, or Firm*—Gerald J. Ferguson, Jr.; Michael P. Hoffman; Ronni S. Malamud

[57] ABSTRACT

In an internal combustion engine having a pair of intake valves, the valve driving system for timing the intake valves is provided with a valve timing changing mechanism for changing the timing of at least one of the intake valves. The valve timing changing mechanism retards or advances the timing of said one intake valve to change the total intake valve opening time, i.e., the time that at least one of the intake valves is open, according to the operating condition of the engine.

16 Claims, 7 Drawing Figures

VALVE TIMING CONTROL SYSTEM FOR INTERNAL COMBUSTION ENGINE

BACKGROUND OF THE INVENTION

1. Field of the Invention

This invention relates to a valve timing control system for an internal combustion engine, and more particularly to a valve timing control system for an internal combustion engine having a pair of intake valves for each cylinder.

2. Description of the Prior Art

There has been proposed an internal combustion engine having a pair of intake ports and a pair of intake valves for each cylinder in which the intake valves are driven at predetermined different times to close and open the corresponding intake port. See Japanese Unexamined Patent Publication No. 56(1981)-44404, for example. By providing two intake ports for each cylinder, the effective area of the intake opening can be enlarged and the volumetric efficiency is improved, whereby the engine output can be improved.

In order to improve the engine output by making the volumetric efficiency high, generally it is preferred that the opening time of the intake valve, i.e., the time that the intake valve opens, be longer for a given area of the intake opening when the engine operates at a high rotational speed, and especially when the engine operates at a high speed under heavy load. When the engine operates at a high speed under heavy load, combustion in the engine is not adversely affected even if the opening time of the intake valve is extended and the valve overlap is extended, since the ratio of the residual exhaust gas to the intake gas is small and back flow of the intake gas does not occur because of the high inertia speed of the intake gas under such operating condition of the engine.

On the other hand, when the opening time of the intake valve is extended during operation of the engine at a low speed under heavy load, back flow of the intake gas occurs since the inertia speed of the intake gas is low, whereby the volumetric efficiency is lowered.

SUMMARY OF THE INVENTION

In view of the foregoing observations and description, the primary object of the present invention is to provide a valve timing control system for an internal combustion engine having a pair of intake valves for each cylinder which can improve the volumetric efficiency without adversely affecting combustion in the engine over all operational regions of the engine from low speed regions to high speed regions.

Another object of the present invention is to provide a valve timing control system for an internal combustion engine having a pair of intake valves for each cylinder in which the total intake valve opening time, i.e., the time that at least one intake valve opens, is variable according to the operating condition of the engine.

In accordance with the present invention, at least one of the valve driving systems for driving the respective intake valves in a timed relation is provided with a valve timing changing mechanism for changing the timing of the corresponding intake valve according to the operating condition of the engine.

By changing the valve timing of at least one of the intake valves for each cylinder to change the overlap time of the valves, the total intake valve opening time can be varied. For example, during heavy load high speed operation of the engine, the timing of one intake valve is retarded while the timing of the other intake valve is fixed or advanced, whereby the total intake valve opening time can be extended to improve the volumetric efficiency. On the other hand, the total intake valve opening time is made relatively short when it is necessary to prevent back flow of intake gas.

Thus, in accordance with the present invention, the opening time of the intake valve can be adjusted to an optimal value to improve the volumetric efficiency according to the operating condition of the engine without substantially changing the effective area of the intake opening.

DESCRIPTION OF THE PREFERRED EMBODIMENT

Figure 1:
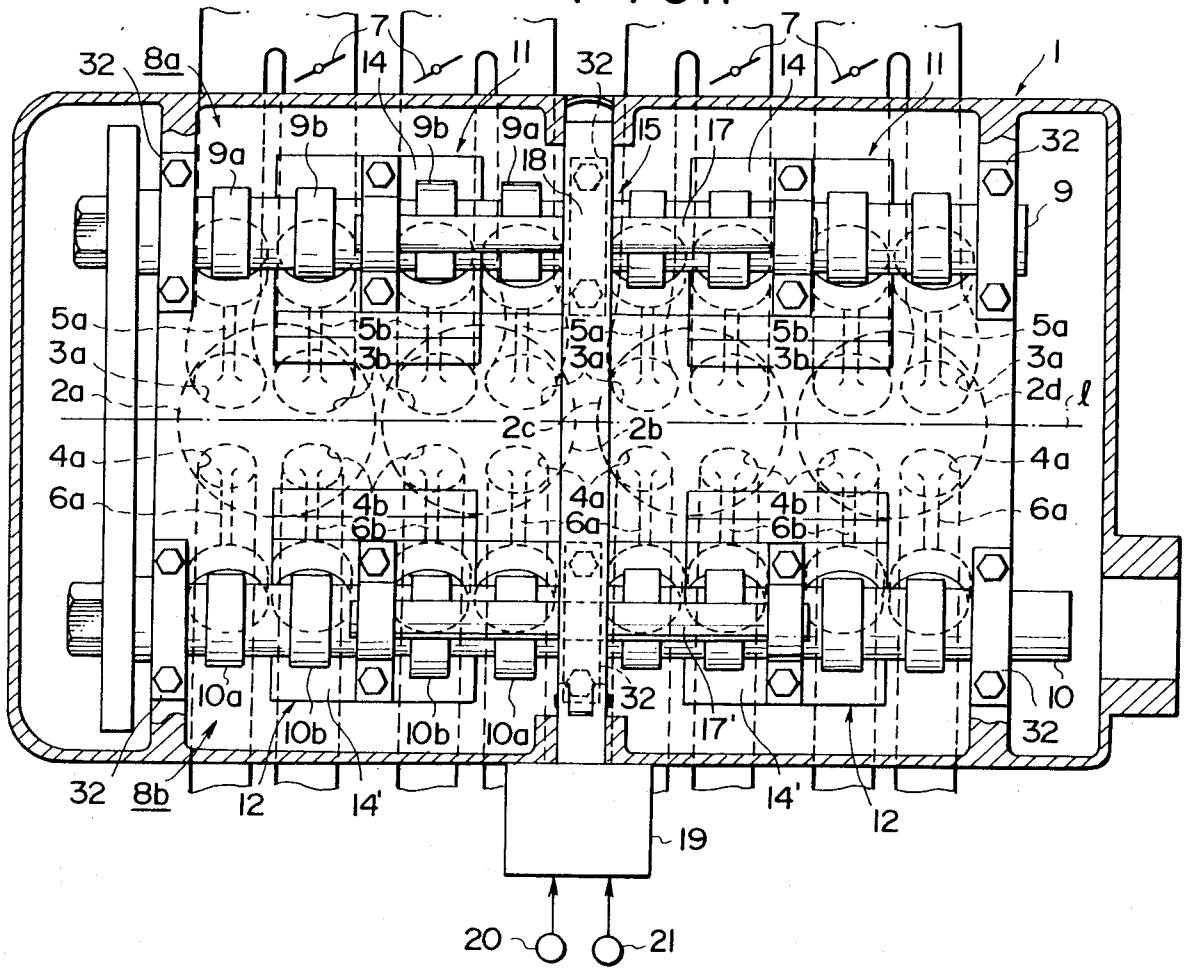
FIG. 1 is a schematic plan view of a dual-induction type four-cylinder engine employing a valve timing control system in accordance with an embodiment of the present invention.
Figure 2:
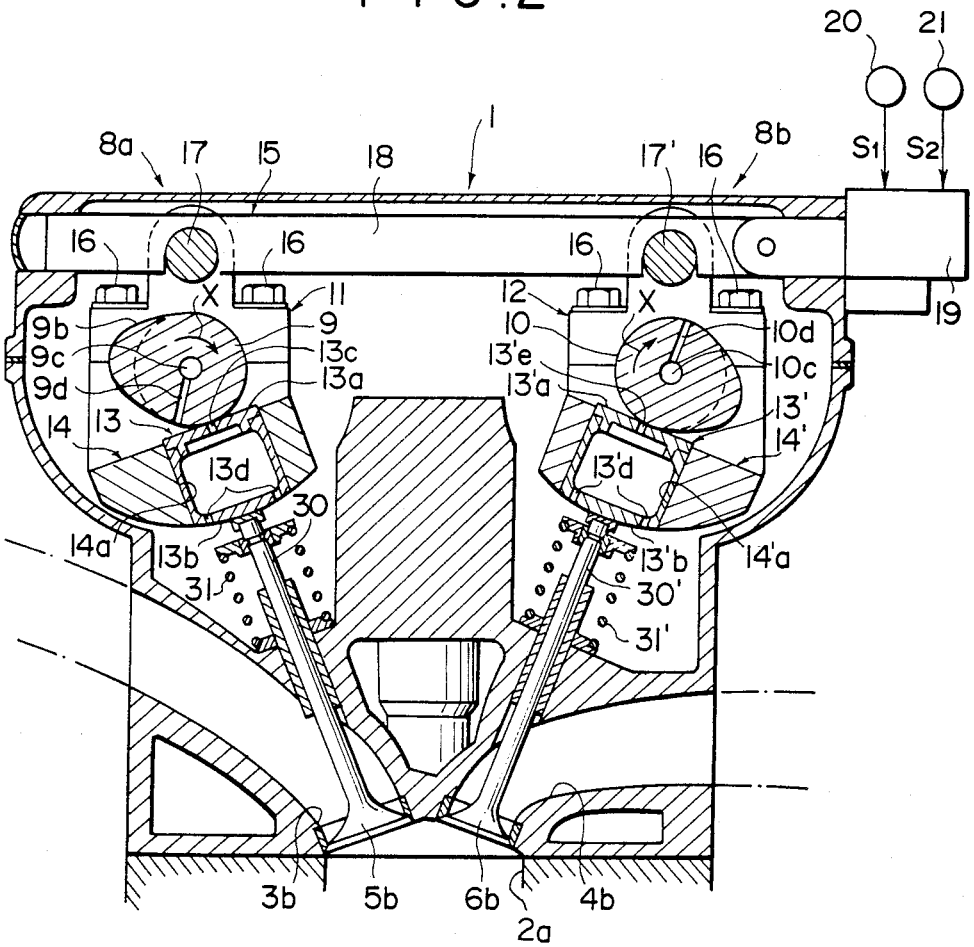
FIG. 2 is a fragmentary cross sectional view of FIG. 1.

FIGS. 1 and 2 show a dual-induction type four-cylinder engine employing a valve timing control system in accordance with an embodiment of the present invention.

In FIG. 1, first to fourth cylinders 2*a* to 2*d* are formed in the engine block 1 in series along the center line l of the engine block 1. Each cylinder is provided with an intake port 3*a* for light load, an intake port 3*b* for heavy load, and first and second exhaust ports 4*a* and 4*b*. As will become apparent later, the intake port 3*b* for heavy load is actually used only when the engine operates under heavy load, while the intake port 3*a* for light load is always used irrespective of the load under which the engine operates. The light load intake port (the intake port for light load) 3*a* and the heavy load intake port (the intake port for heavy load) 3*b* of each cylinder open in the cylinder on one side of the center line l of the engine block 1 and are arranged in a line substantially parallel to the center line l. The cross sectional area of the passage leading to the light load intake port 3*a* is narrowed to increase the flow velocity of intake gas passing therethrough and at the same time the passage leading to the light load intake port 3*a* is curved to produce swirls in the cylinder. On the other hand, the cross sectional area of the heavy load intake port 3*b* is relatively large to improve the volumetric efficiency. The first and second exhaust ports 4*a* and 4*b* of each cylinder open in the cylinder on the other side of the center line l of the engine block 1 and are arranged in a line substantially parallel to the center line l. The light load intake port 3*a* and the heavy load intake port 3*b* are respectively opposed to the first exhaust port 4a and the second exhaust port 4b. The light load intake port 3a and the heavy load intake port 3b are arranged in this order from the left as seen in FIG. 1 in the first and third cylinders 2a and 2c, and in the reverse order in the second and fourth cylinders 2b and 2d so that the heavy load intake ports 3b of the first and second cylinders 2a and 2b are adjacent to each other and the heavy load intake ports 3b of the third and fourth cylinders 2c and 2d are adjacent to each other. Similarly, the first and second exhaust ports 4a and 4b are arranged in this order from the left as seen in FIG. 1 in the first and third cylinders 2a and 2c, and in the reverse order in the second and fourth cylinders 2b and 2d so that the second exhaust ports 4b of the first and second cylinders 2a and 2b are adjacent to each other and the second exhaust ports 4b of the third and fourth cylinders 2c and 2d are adjacent to each other.

The light load intake port 3a, the heavy load intake port 3b, the first exhaust port 4a and the second exhaust port 4b are provided with a light load intake valve 5a, a heavy load intake valve 5b, a first exhaust valve 6a and a second exhaust valve 6b, respectively, which open and close the corresponding ports in a timed relation.

The passages leading to the respective heavy load intake valves 3b are provided with a valve 7 which is opened only when the engine operates under heavy load. During light load operation of the engine, intake gas is introduced into each cylinder only through the light load intake port 3a, while during heavy load operation of the engine, intake gas is introduced into each cylinder through both the light load intake port 3a and the heavy load intake port 3b with the valve 7 being opened.

On the intake side of the engine block 1 is disposed a first valve driving mechanism 8a for controlling the light load intake valves 5a and the heavy load intake valves 5b of the respective cylinders 2a to 2d. The first valve driving mechanism 8a includes a first camshaft 9 which extends in parallel to the center line l of the engine block 1 on the intake side thereof and is rotated by the crankshaft (not shown) of the engine. The first camshaft 9 is provided with cams 9a for timing the light load intake valves 5a of the respective cylinders 2a to 2d and cams 9b for timing the heavy load intake valves 5b of the respective cylinders 2a to 2d. The cam 9a and the cam 9b are equal to each other in shape and size so that the intake valves 5a and 5b are opened for the same time interval.

Similarly, on the exhaust side of the engine block 1 is disposed a second valve driving mechanism 8b for controlling the first and second exhaust valves 6a and 6b of the respective cylinders 2a to 2d. The second valve driving mechanism 8b includes a second camshaft 10 which extends in parallel to the center line l of the engine block 1 on the exhaust side thereof, and is rotated by the crankshaft (not shown) of the engine. The second camshaft 10 is provided with cams 10a for timing the first exhaust valves 6a of the respective cylinders 2a to 2d and cams 9b for timing the second exhaust valves 6b of the respective cylinders 2a to 2d. The cam 10a and the cam 10b are equal to each other in shape and size so that the exhaust valves 6a and 6b are opened for the same time interval.

The movement of each cam is transmitted to the corresponding valve by way of a tappet member to open the valve when the cam lobe abuts against the tappet member as is well known in the art, and the valve timing is determined by the angular position of the cam lobe with respect to the tappet member.

In this embodiment, the tappet member associated with the heavy load intake valve 5b and the tappet member associated with the second exhaust valve 6b are respectively supported by swinging members 14 and 14' which can be swung with respect to the first and second camshafts 9 and 10, respectively, the swinging members 14 and 14' constituting first and second valve timing changing mechanisms 11 and 12.

As shown in FIG. 2, the movement of the cam 9b for timing the heavy load intake valve 5b is transmitted to the valve stem 30 of the heavy load intake valve 5b by way of a tappet member 13 to move downward the heavy load intake valve 5b to open the heavy load intake port 3b when the cam lobe of the cam 9b abuts against the tappet member 13. The tappet member 13 is like a box in cross section and has a cam abutting face 13a adapted to abut against the cam 9b and a valve stem abutting face 13b adapted to abut against the top surface of the valve stem 30 of the heavy load intake valve 5b. The heavy load intake valve 5b is urged upward by a coil spring 31 associated with the valve stem 30 to normally close the heavy load intake port 3b. The first camshaft 9 is provided with a longitudinal oil passage 9c which extends in the longitudinal direction of the camshaft 9 and is connected to an oil pump (not shown), and witha radial oil passage 9d through which oil fed through the longitudinal oil passage 9c under pressure flows outside to lubricate the surface of the cam 9b and the tappet member 13. The oil lubricating the surfaces drops toward the valve stem abutting face 13b through a central hole 13c in the cam abutting face 13a and lubricates the valve stem abutting face 13b through the small holes 13d formed in the valve stem abutting face 13b near the edges.

In this embodiment, a pair of first valve timing changing mechanisms 11 are provided, one for changing the valve timing of the adjacent heavy load intake valves 5b of the first and second cylinders 2a and 2b, and the other for changing the valve timing of the adjacent heavy load intake valves 5b of the third and fourth cylinders 2c and 2d. Since the first valve timing changing mechanisms 11 are identical to each other, only the first valve timing changing mechanism 11 for the first and second cylinders 2a and 2b will be described, hereinbelow.

Figure 3:
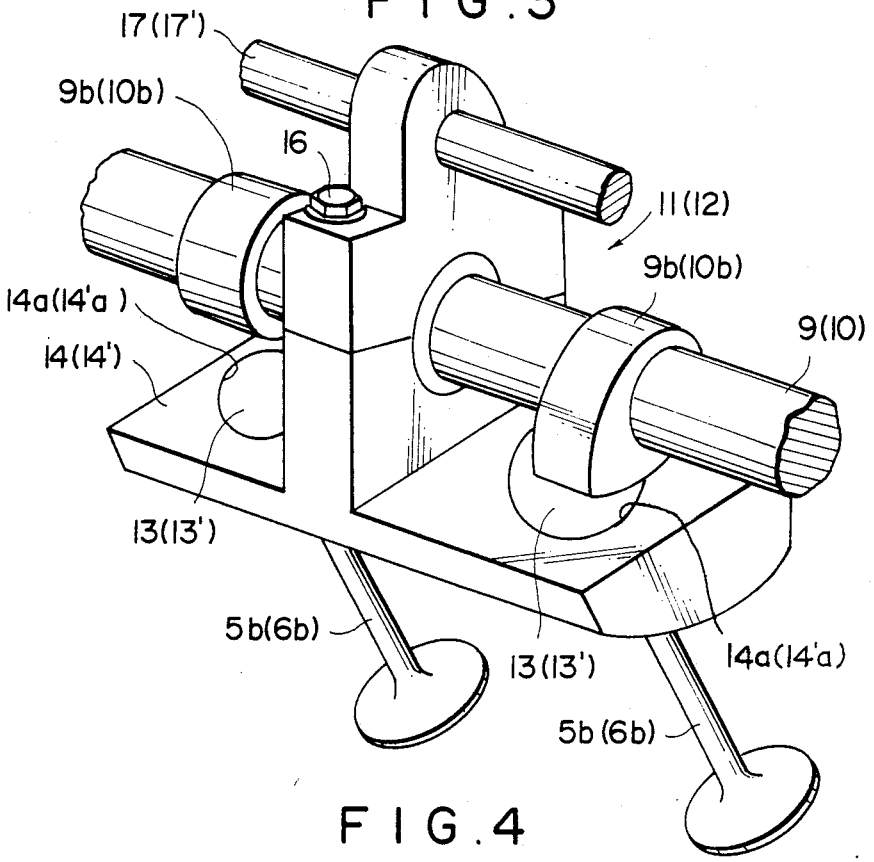
FIG. 3 is an enlarged perspective view of the valve timing changing mechanism employed in the valve timing control system shown in FIG. 1.

As shown in FIG. 3, the first valve timing changing mechanism 11 comprises a swinging member 14 formed of an upper half having a semicircular recess on the lower end thereof and a lower half having a semicircular recess on the upper end thereof which are secured together by means of bolts 16 (only one bolt 16 is visible in FIG. 3) with the first camshaft 9 snugly received in the circular opening formed by the semicircular recesses to permit swinging movement of the swinging member 14 about the first camshaft 9. A connecting rod 17 extends through the swinging member 14 at the top thereof above the first camshaft 9. The connecting rod 17 is operatively connected to a control device 15 to swing the swinging member 14 with respect to the first camshaft 9 under the control of the control device 15 as will be described in detail hereinafter.

A pair of tappet receiving holes 14a are provided in the horizontal portion of the swinging member 14. The tappet member 13 associated with the heavy load intake valve 5b of the first cylinder 2a is snugly received in one of the tappet receiving holes 14a for sliding movement substantially in the axial direction of the valve stem 30, and the same associated with the heavy load intake valve 5b of the second cylinder 2b is received in the other tappet receiving hole in the same manner.

Said connecting rod 17 extends in parallel to the center line l of the engine block 1 to connect the swinging members 14 of both first valve timing changing mechanisms 11. The control device 15 (See also FIGS. 1 and 2) comprises a reciprocating shaft 18 which extends in perpendicular to the center line l and is engaged with the connecting rod 17 to swing the connecting rod 17 in response to the reciprocating movement thereof, and a driving motor 19 which drives the reciprocating shaft 18 in reciprocation. An output signal S1 of a rotational speed sensor 20 and an output signal S2 of a load sensor 21 are inputted into the driving motor 19 in order to control it according to the operating condition of the engine. As can be seen from FIG. 2, when the swinging member 14 and accordingly the tappet member 13 held by the swinging member 14 are swung with respect to the first camshaft 9 and the cam 9b thereon, the contacting point between the cam 9b and the tappet member 13 at a given angular position of the first camshaft 9 is changed, whereby the valve timing is changed. For example, when the swinging member 14 is swung in the rotating direction of the first camshaft 9 indicated by the arrow X in FIG. 2, the valve opening timing is retarded, and vice versa. The driving motor 19 is controlled to swing the swinging member 14 and the tappet member 13 in the direction of the arrow X to retard the opening timing of the heavy load intake valve 5b by way of the reciprocating shaft 18 and the connecting rod 17 when it is determined that the engine operates at a high speed under heavy load by way of the output signals S1 and S2. Since all the swinging members 14 associated with the heavy load intake valves 5b of the first to fourth cylinders 2a to 2d are connected to the same connecting rod 17, all the heavy load intake valves 5b are changed in valve timing by the same amount at the same time.

Like in the first valve timing changing mechanism 11, the movement of the cam 10b for timing the second exhaust valve 6b in the second valve timing changing mechanism 12 is transmitted to the valve stem 30' of the second exhaust valve 6b by way of a tappet member 13' which is identical to the tappet member 13 associated with the heavy load intake valve 5b. The second valve timing changing mechanism 12 is identical to the first valve timing changing mechanism 11 described above, and therefore will not be described in detail here. Components of the second valve timing changing mechanism 12 are indicated by reference numerals in brackets in FIG. 3. The connecting rod 17' connecting the two swinging members 14' of the second valve timing changing mechanisms 12 is operatively connected to the reciprocating shaft 18 of the control device 15 so that the swinging members 14' are swung in response to the reciprocating movement of the reciprocating shaft 18 together with the swinging members 14 of the first valve timing changing mechanisms 11. Therefore, the heavy load intake valves 5b and the second exhaust valves 6b are changed in valve timing by the same amount in the direction at the same time.

Again referring to FIG. 1, the first and second camshafts 9 and 10 are supported for rotation by bearing portions 32 which are positioned at the ends and an intermediate portion of the engine block 1 so as not to interfere with the swinging members 14 and 14' and to prevent flex of the camshafts 9 and 10.

Figure 5:
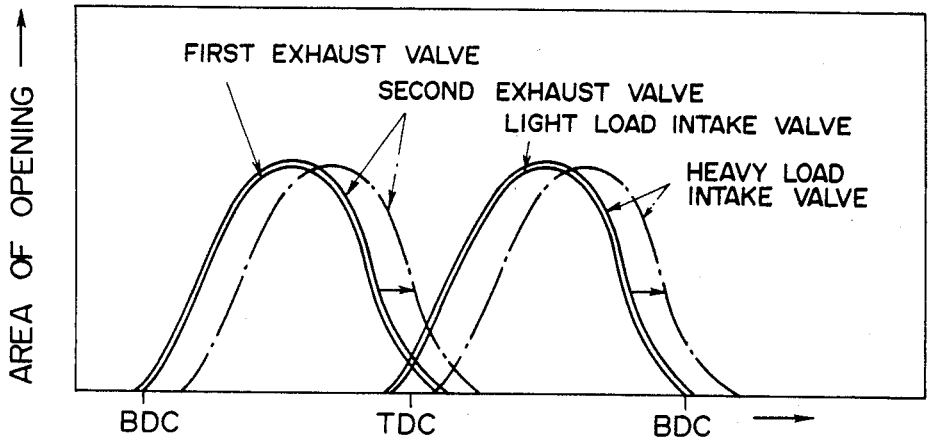
FIG. 5 is a view illustrating a change in the valve timing made in accordance with the present invention.

When the engine is operating under light load, the swinging members 14 and 14' are in a normal position and the light load intake valve 5a, the heavy load intake valve 5b, and the first and second exhaust valves 6a and 6b of each cylinder are opened and closed in a predetermined valve timing shown by solid lines in FIG. 5. That is, both the exhaust valves 6a and 6b start to open near BDC of the piston and close near TDC, while both the intake valves 5a and 5c start to open near TDC and close near BDC with the valve overlap (the time that the intake valve and the exhaust valve are both open) being kept short. Though the heavy load intake valve 5b is opened and closed during light load operation of the engine, intake gas cannot be fed through the heavy load intake port 3b since the valve 7 is closed.

Thus during light load operation of the engine, intake gas is introduced into each cylinder only through the light load intake port 3a. Therefore, intake gas is drawn into the cylinder at a high speed to generate a swirl therein, whereby the combustion rate in the combustion chamber can be increased to improve combustion therein. Further, the short valve overlap reduces the amount of residual exhaust gas, which contributes to improvement in combustion during light load operation of the engine.

When the engine is operating at a low speed under heavy load, the valve 7 in each heavy load intake port 3b is opened though the valve timing is kept as shown by the solid lines in FIG. 5, i.e., the valve timing changing mechanisms 11 and 12 are not actuated. Thus intake gas is introduced into the cylinder through both the light load intake port 3a and the heavy load intake port 3b. However, back flow of the intake gas does not occur since the total opening time of the intake ports is still kept relatively short and the intake ports are closed comparatively earlier. Accordingly, the volumetric efficiency is highly improved during heavy load low speed operation of the engine. Further, since exhaust gas is scavenged from the cylinder through the two exhaust ports 4a and 4b in this embodiment, the scavenging efficiency is increased as compared with the case where exhaust gas is scanvenged through a single exhaust port. This also contributes to improvement in the volumetric efficiency.

When the engine is operating at a high speed under heavy load, the valve 7 in each heavy load intake port 3b is opened and at the same time the valve timing changing mechanisms 11 and 12 are actuated to retard the valve timing of the heavy load intake valve 5b and the second exhaust valve 6b as shown by chained-lines in FIG. 5. At this time, the valve timing of the light load intake valve 5a and the first exhaust valve 6b is not changed. Thus the total intake valve opening time, i.e., the time that at least one of the light load intake valve 5a and the heavy load intake valve 5b is open, is extended by the amount by which the opening timing of the heavy load intake valve 5b is retarded. This, in addition to the fact that the total intake valve opening time is extended in the direction of retardation where the inertia of the intake gas is large, highly improves the volumetric efficiency, thereby increasing the power output of the engine during heavy load high speed operation of the engine.

At the same time, the total exhaust valve opening time is also extended in the exhaust stroke and the scanvenging efficiency is improved, which also contributes to improvement in the volumetric efficiency. Further, since the amount of intake gas is large and the inertia velocity of the intake gas is high during heavy load high speed operation of the engine, the amount of residual exhaust gas can be made small and back flow of intake gas does not occur even if the valve overlap is extended and the opening time of the intake valve is retarded into the compression stroke. Accordingly, combustion in the engine is not adversely affected.

As described above, the first and second valve timing changing mechanisms 11 and 12 are driven by the driving motor 19 by way of the reciprocating shaft 18 and the connecting rods 17 and 17'. Now an example of a control system for controlling the driving motor 19 will be described referring to FIGS. 6 and 7.

Figure 6:
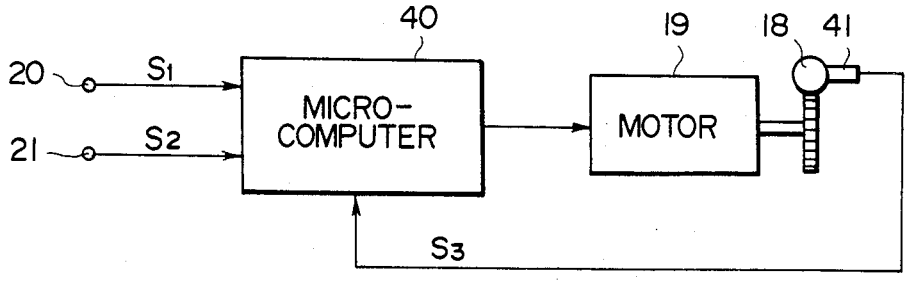
FIG. 6 is a schematic view of an example of a controlling system for controlling the driving motor for actuating the valve timing changing mechanism according to the operating condition of the engine.

As shown in FIG. 6, the driving motor 19 is controlled by a microcomputer 40 into which the output signals S1 and S2 from the rotational speed sensor 20 and the load sensor 21 are inputted. A position sensor 41 is provided for detecting the position of the reciprocating shaft 18. The output signal S3 of the position sensor 41 is inputted into the microcomputer 40.

Figure 7:
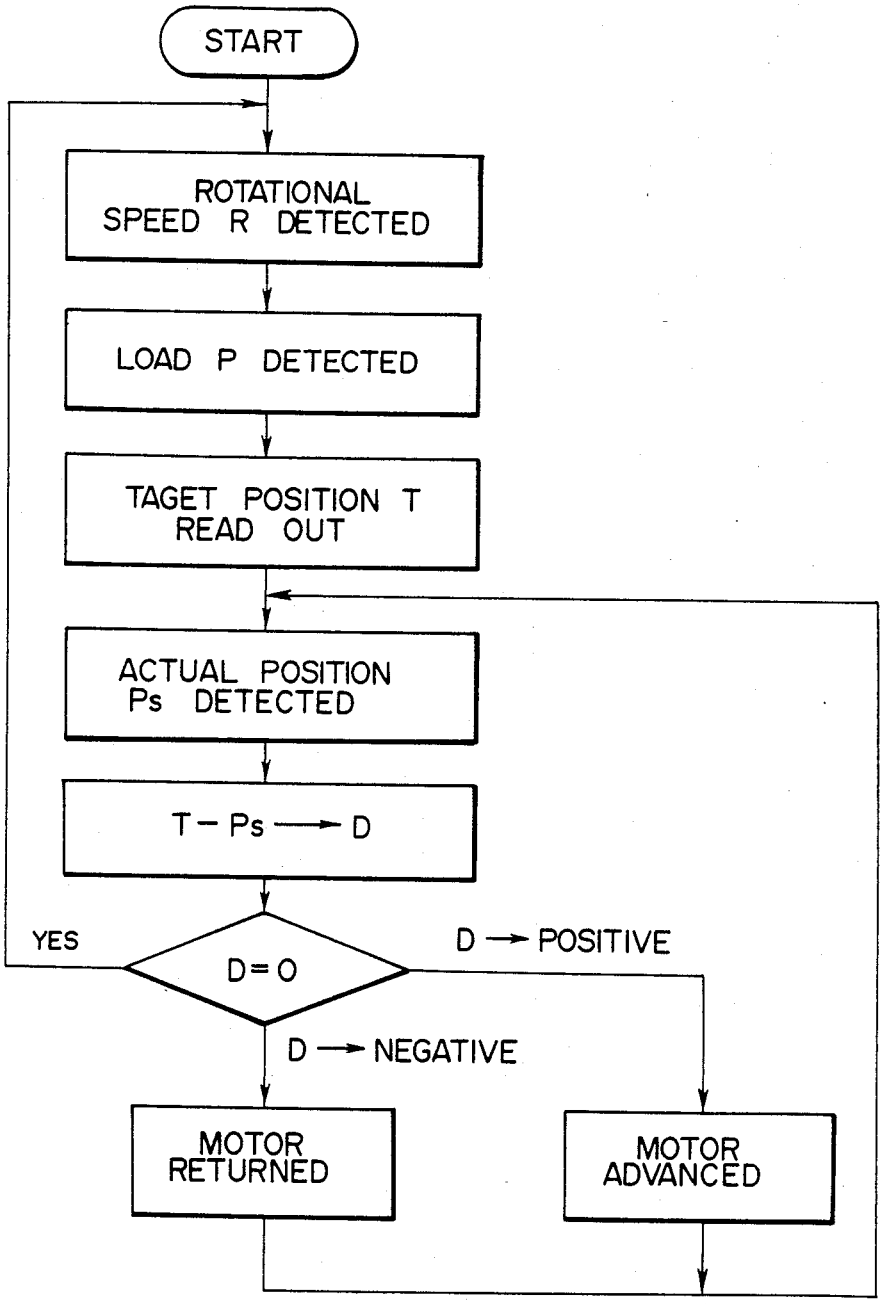
FIG. 7 is a flow chart of the operation of the microcomputer employed in the system shown in FIG. 6.

FIG. 7 shows the flow chart of the operation of the microcomputer 40. The computer 40 first determines the rotational speed R of the engine from the output signal S1 of the rotational speed sensor 20 and then determines engine load P from the output signal S2 of the load sensor 21. The microcomputer 40 has a ROM in which is stored a map representing the relationship of the target position T of the reciprocating shaft 18 to the rotational speed R and the engine load P, and the computer 40 reads out the target position T of the reciprocating shaft 18 corresponding to the rotational speed R and the computer 40 reads out the target position T of the reciprocating shaft 18 corresponding to the rotational speed R and the engine load P determined. Then the actual position Ps of the reciprocating shaft 18 is determined from the output signal S3 of the position sensor 41. The difference D between the target position T and the actual position Ps of the reciprocating shaft 18 is calculated subsequently. When the difference D is nil, the driving motor 19 is not actuated and the reciprocating shaft 18 is held in the position. When the difference D is positive or negative, the driving motor 19 is actuated to rotate in one direction or the other to move the reciprocating shaft 18 by an amount corresponding to the absolute value of the difference D back or forth according to the sign of the difference D. When the map stored in the ROM is appropriately arranged, the valve timing can be continuously changed with increase in load and/or rotational speed.

Though in the above embodiment, the movement of each cam is transmitted to each valve by way of the box-like tappet member, the tappet member may be of various other types. For example, a hydraulic tappet device shown in FIG. 4 may be used. The hydraulic tappet device is advantageous in that it is always in contact with the cam without generating a so-called valve clearance therebetween even when the engine is operating at a high speed, and therefore the movement of the cam can be transmitted to the valve stem in an optimal manner.

Figure 4:
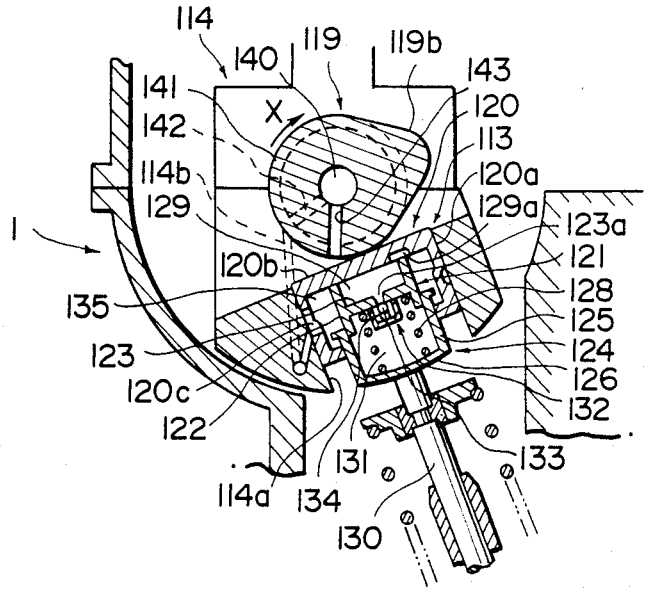
FIG. 4 is a fragmentary cross sectional view showing a modification of the embodiment shown in FIG. 1.

In FIG. 4, the hydraulic tappet device 113 includes a first member 120 which has a cylindrical side wall **120*a* and a base wall 120*b* on one end of the side wall 120*a* and is open at the other end of thereof. The first member 120 is snugly received in the tappet receiving hole 114*a* formed in the swinging member 114 for sliding movement in the axial direction of the valve stem 130 with the open end directed toward the valve stem 130. A second member 121 which has a cylindrical side wall 122 having a diameter smaller than that of the first member 120 is received in the first member 120. The second member 121 is substantially H-shaped in cross section and has a partition wall 123. The partition wall 123 is provided with a central orifice 123*a*, the purpose of which will become apparent later. A third member 124 has a cylindrical side wall 125 and a base wall 126 at one end, and opens at the other end. The open end of the third member 124 is inserted into the open end of the first member 120 with one end of the second member 121 being received in the open end of the third member 124 so that the third member 124 can be telescopically slid in liquid-tight fashion with respect to both the first and second members 120 and 121. A coil spring 128 is compressed between the inner surface of the base wall 126 of the third member 124 and the outer surface of the partition wall 123 of the second member 121 remote from the base wall 120*b* of the first member 120, whereby the second member 121 is resiliently pressed against the base wall 120*b* of the first member 120. Between the inner surface of the base wall 120*b* of the first member 120 and the inner surface of the partition wall 123 of the second member 121 is formed an oil well 129. A hydraulic pressure chamber 131 is formed between the inner surface of the base wall 126 of the third member 124 and the outer surface of the partition wall 123 of the second member 121. Said central orifice 123*a* in the partition wall 123 communicates the oil well 129 with the hydraulic pressure chamber 131. A check valve 132 comprising a ball 133 and a coil spring 134 for urging the ball 133 against the outer surface of the partition wall 123 to close the central orifice 123*a* is disposed on the outer surface of the partition wall 123. The camshaft 119 having a cam 119*b* mounted thereon is provided with a longitudinal oil passage 140 extending in the longitudinal direction of the camshaft 119 and an annular oil passage 141 formed on the outer periphery thereof, the annular oil passage 141 being connected with the longitudinal oil passage 140 by way of a radial oil passage 142. The longitudinal oil passage 140 is connected to an oil pump (not shown). The swinging member 114 supporting the hydraulic tappet device 113 is provided with an oil passage 114*b* which is opposed to the annular oil passage 141 at one end and opens in a communicating opening 120*c* formed in the side wall 120*a* of the first member 120 at the other end. Oil fed through the longitudinal oil passage 140 in the camshaft 119 under pressure is introduced into the annular space 135 formed between the outer surface of the side wall 122 of the second member 121 and the inner surface of the side wall 120*a* of the first member 120 by way of the radial oil passage 142, the annular oil passage 141, the oil passage 114*b* in the swinging member 114 and the communicating opening 120*c*, and into the oil well 129 through a communicating passage 129*a* formed between the inner surface of the base wall 120*b* of the first member 120 and the outer end of the side wall 122 of the second member 121. Further, the oil introduced into the oil well 129 is fed to the hydraulic pressure chamber 131 under pressure through the central orifice 123*a* of the second member 121. The check valve 132 permits the oil to flow into the pressure chamber 131 but prevents flow of oil from the pressure chamber 131 to the oil well 129. As oil is introduced into the pressure chamber 131 the third member 124 moves away from the base wall 120*b* of the first member 120 to extend the overall length of the tappet device 113 and finally the outer surface of the base wall 120***b* of the first member 120 and the outer surface of the base wall 126 of the third member 124 abut against the cam 119*b* and the top surface of the valve stem 130, respectively.

When the cam lobe of the cam 119*b* comes around and the tappet device 113 is pushed downward, the tappet device 113 acts like a solid tappet member to push the valve stem 130 downward, since the oil in the pressure chamber 131 cannot escape from the chamber 131 because of the action of the check valve 132. When a clearance is generated between the cam 119 and the outer surface of the base wall 120*b* of the first member 120, the hydraulic pressure in the pressure chamber 131 is reduced. Accordingly, oil flows into the pressure chamber 131 through the central orifice 123*a* to lift the first member 120 by way of the second member 121, whereby the clearance is taken up.

Reference numeral 143 in FIG. 4 indicates an oil passage for lubricating the surface of the cam 119 and the outer surface of the base wall 120*b* in contact with the cam 119.

Though in the embodiment shown in FIG. 1, the present invention is applied to a dual-induction type internal combustion engine in which a valve 7 is provided in the heavy load intake port so that intake gas is actually fed through the heavy load intake port only during heavy load operation of the engine, the present invention can be applied to any type engine insofar as it has a pair of intake valves for each cylinder. For example, the valve 7 need not be provided in the heavy load intake port. The present invention may be applied even to a single cylinder-engine.

Further, in the above embodiment, only the timing of the heavy load intake valve is changed with the timing of the light load intake valve being fixed. However, both the intake valves may be changed in the respective timings according to the operating condition of the engine. For example, the timing of the light load intake valve may be advanced with the timing of the heavy load intake valve being retarded to further extend the total intake valve opening time during heavy load high speed operation of the engine. That is, the important feature of the present invention is that the valve timing of at least one of the intake valves is variable and is controlled to change the total intake valve opening time according to the operating condition of the engine. The valve timing may be continuously changed with change in operating condition of the engine such as the rotational speed or load. For example, when the timing of the heavy load intake valve and the second exhaust valve is gradually retarded with increase in the rotational speed of the engine, torqueshock which could occur if the total intake valve opening time is abruptly changed by a large amount can be avoided.

As the valve timing changing mechanism, various mechanisms can be used. For example, those in which the relative position of the camshaft to the output shaft is changed or those in which a three-dimensional camshaft is slid to change the valve timing can be used, though the valve timing changing mechanism shown in the above embodiment is preferable because of its simple structure, quick response and low noise.

Further in the embodiment shown in FIG. 1, all the intake valves of the four cylinders are arranged on one side of the center line of the engine block and all the exhaust valves of the four cylinders are arranged on the other side of the same, and the order of the intake valves and the exhaust valves in each cylinder is arranged so that the heavy load intake valves of the first and second cylinders, and the third and fourth cylinders are positioned adjacent to each other in the respective cylinder pairs, and so that the second exhaust valves are positioned adjacent to each other in the respective cylinder pairs. This arrangement is advantageous in that the timing of the heavy load intake valves and the second exhaust valves of the two cylinders can be changed using a single swinging member without interfering with the bearing portions supporting the camshafts at three points. However, any other arrangement of the valves may be used.

Further, though in the above embodiment, the swinging members 14 and 14' are normally held in the position in which valve timings shown by the solid line in FIG. 5 are given, and are moved to the position in which valve timings shown by the chained line in FIG. 5 is given during heavy load high speed operation of the engine, the swinging members 14 and 14' may be normally held in the latter position to be moved to the former position during operation of the engine under other conditions. If necessary, the total intake valve opening time may also be changed according to any other operating condition of the engine as well.

What is claimed is:

1. A valve timing control system for an internal combustion engine having at least one cylinder, said cylinder defining a combustion chamber of the engine, comprising a pair of intake ports communicating with said combustion chamber and a pair of intake valve provided for each cylinder which open and close respective intake ports; valve operating means for opening and closing said intake valves in a timed relation in synchronization with rotation of the engine, an opening period of each intake valve being kept substantially constant; and a valve timing changing means for controlling opening and closing timing of one of said intake valves for each cylinder by shifting the opening timing and closing timing of one intake valve in the same direction with the opening timing and closing timing of the other intake valve being fixed without substantially changing the opening period of said valves so that the opening timing and closing timing of one of said intake valves are retarded with the total intake valve opening period being relatively elongated during operation of the engine at high speed under heavy load as compared with that during operation of the engine at low speed under heavy load so as to prevent back flow when said intake valve are closed, thereby improving the volumetric efficiency, said total intake valve opening period being the period that at least one of the intake valves is open, said total intake valve opening period at least during operation of the engine at high speed under heavy load being determined by the opening timing of one intake valve which is earlier than that of the other intake valve and the closing timing of said other intake valve.

2. A valve timing control system as defined in claim 1 wherein said valve timing changing means controls said valve timing so as to be retarded as the engine is operated at higher speed.

3. A valve timing control system as defined in claim 1 in which one of said intake ports is for light load operation of the engine and the other intake port is for heavy load operation of the engine, the opening timing of the intake valve for the intake port for heavy load operation being changed to change the total intake valve opening time.

4. A valve timing control system as defined in claim 3 in which said intake port for heavy load operation is provided with an additional valve means which opens the intake port only when the engine operates under heavy load.

5. A valve timing control system as defined in claim 3 in which the opening timing of the intake valve for said intake port for heavy load operation is at least during heavy load low speed operation held substantially the same as that of the intake valve for light load operation and is retarded to extend the total intake valve opening time during heavy load high speed operation of the engine.

6. A valve timing control system as defined in cliam 1 in which said engine has first and second exhaust ports and first and second exhaust valves for opening and closing the respective exhaust ports in a timed relation, and which further comprises valve operating means for opening and closing said exhaust valves and a valve timing changing means for changing the timing of at least one exhaust valve to change the total exhaust valve opening time which is the time that at least one exhaust valve is open.

7. A valve timing control system as defined in claim 6 in which said total exhaust valve opening time is changed by changing the opening timing of the second exhaust valve with the opening timing of the first exhaust valve being fixed.

8. A valve timing control system as defined in claim 7 in which said total exhaust valve opening time is changed in response to change of the total intake valve opening time.

9. A valve timing control system as defined in claim 8 in which the valve timing changing mechanisms for the intake valve and for the exhaust valve are operatively connected with each other so that the total intake valve opening time and the total exhaust valve opening time are changed by the same amount in the same direction.

10. A valve timing control system as defined in claim 1 wherein a valve opening and closing timing of one of the intake valves is fixed and a valve opening and closing timing of the other of the intake valves is variable while constantly maintaining the total intake valve opening time thereof.

11. A valve timing control system as defined in claim 10 wherein the valve opening timing of said the other intake valve at its most advanced opening timing is substantially the same as the fixed valve opening timing of said on of the intake valves.

12. A valve timing control system as defined in claim 11 wherein the variable valve opening and closing timing is retarded during heavy load high speed operation of the engine to increase the total intake valve opening time.

13. A valve timing control system for an internal combustion engine having at least one cylinder, said cylinder defining a combustion chamber of the engine, comprising a pair of intake ports communicating with said combustion chamber and a pair of intake valves provided for each cylinder which open and close respective intake ports; valve operating means for opening and closing said intake valves in a time relation in synchronization with rotatIon of the engine, an opening period of each intake valve being kept constant; and a valve timing changing means for changing the total intake valve opening period by changing the opening timing of one intake valve with the opening timing of the other intake valve being fixed, said total intake valve opening period being the time that at least one of the intake valves is open and extending from the opening timing of the intake valve that opens first to the closing timing of the intake valve that closes last; in which each valve timing changing means comprises a swinging member pivotally swingable about the rotating axis of the camshaft of the engine on which the cam for timing the corresponding valve is mounted, the swinging member supporting a tappet member which transmits the movement of the cam to the valve stem of the corresponding valve to open and close it, the valve timing changing means being arranged to swing the swinging member about the camshaft together with the tappet member to change the valve timing.

14. A valve timing control system as defined in claim 13 in which said engine has an even number of cylinders arranged in a line and the intake valve the opening timing of which is to be fixed and the intake valve the opening timing of which is to be changed are arranged in parallel to the line in this order in odd-numbered cylinders as numbered from one end of the line and in the reverse order in even-numbered cylinders so that the intake valves the opening timing of which is to be changed in each pair of the adjacent odd-numbered and even-numbered cylinders are positioned adjacent to each other, said swinging members for said tappet members associated with each pair of the adjacent intake valves the opening timing of which is to be changed are integrally formed with each other.

15. A valve timing control system as defined in claim 14 further comprising a first exhaust port and a second exhaust port communicating with said combustion chamber and a first exhaust valve and a second exhaust valve provided for each cylinder which open and close said first exhaust port and said second exhaust port, respectively; exhaust valve operating means for opening and closing said first and second exhaust valves in a timed relation in synchronization with rotation of the engine; and an exhaust valve timing changing means for controlling the opening and closing timing of at least one of said first and second exhaust valves for each cylinder; in which each exhaust valve timing changing means comprises a second swinging member pivotally swingable about the rotating axis of the camshaft of the engine on which the cam for timing the corresponding exhaust valve is mounted, the second swinging member supporting an exhaust valve tappet member which transmits the movement of the cam to the valve stem of the corresponding exhaust valve to open and close it, the exhaust valve timing changing means being arranged to swing the second swining member about the camshaft together with the exhaust valve tappet member to change the valve timing; wherein the first and second valves are arranged in parallel to the line of the cylinders in this order in the odd-numbered cylinders and in the reverse order in the even-numbered cylinders so that the second exhaust valves in each pair of the adjacent odd-numbered and even-numbered cylinders are positioned adjacent to each other, and said second swinging members for said exhaust valve tappet members associated with each pair of the adjacent exhaust valves are integrally formed with each other.

16. A valve timing control system as defined in claim 8 wherein both the total intake valve opening time and the total exhaust valve opening time are increased during heavy load high speed operation of the engine.

* * * * *